United States Patent [19]

Ariyama et al.

[11] 4,059,394

[45] Nov. 22, 1977

[54] HEAT FIXING APPARATUS FOR USE IN A WET ELECTROPHOTOGRAPHIC COPYING MACHINE

[75] Inventors: Kenzo Ariyama, Tokyo; Hiroshi Mano, Yokohama; Shinichi Kamiyama, Tokyo, all of Japan

[73] Assignee: Ricoh Co., Ltd., Japan

[21] Appl. No.: 609,550

[22] Filed: Sept. 2, 1975

[30] Foreign Application Priority Data

Sept. 5, 1974 Japan ..... 49-102243

[51] Int. Cl.[2] ..... F27B 9/28; G03G 15/00

[52] U.S. Cl. ..... 432/59; 34/95; 219/216; 355/3 R

[58] Field of Search ..... 355/3 R, 10; 219/216, 219/385, 388; 432/59; 34/148, 151, 95

[56] References Cited

U.S. PATENT DOCUMENTS

| | | | |
|---|---|---|---|
| 3,464,680 | 9/1969 | Nakamura et al. | 432/59 |
| 3,628,440 | 12/1971 | Czarnikow et al. | 219/216 X |
| 3,772,497 | 11/1973 | Gray et al. | 355/3 R X |
| 3,878,622 | 4/1975 | Knechtel et al. | 432/59 X |

*Primary Examiner*—John Gonzales

*Attorney, Agent, or Firm*—McGlew and Tuttle

[57] ABSTRACT

The apparatus heat fixes a toner image on one surface of a wet-developed, image-carrying copy sheet while maintaining the opposite surface of the sheet in sliding contact with the surface of a heated plate. A portion of the heating surface is formed with a concave surface, or a curved surface having a positive curvature, and there is provided a guide roller for introducing the sheet onto the curved surface. When introduced onto the curved surface, the sheet achieves a good sliding contact with the heating surface by virtue of its resiliency without application of a back pressure thereto, thus accomplishing an efficient heat fixing without any accompanying degradation in the image quality.

3 Claims, 6 Drawing Figures

HEAT FIXING APPARATUS FOR USE IN A WET ELECTROPHOTOGRAPHIC COPYING MACHINE

BACKGROUND OF THE INVENTION

The invention relates to an apparatus, for use in a wet electrophotograhic copying machine, which heat fixes a wet developed toner image by maintaining a copy sheet, which serves as an image carrier for the toner image, in contact with a heated plate, and more particularly to such a heat fixing apparatus which increases the the degree of contact between the heated plate and the copy sheet to improve heat fixing efficiency without damaging the image quality.

For convenience in understanding the invention, a conventional wet electrophotographic copying machine will be intially described with reference to FIG. 1. In this Figure, there is shown a photosensitive drum 1 having a photoconductive layer on its surface and which rotates in the direction indicated by an arrow. A charger 2, an exposure unit 3, a developing unit 4, a device 5 for removing excess developing solution and a transfer charger 6 are disposed in sequence around the priphery of the photosensitive drum 1. The drum 1 has its surface uniformly charged by the charger 2, and an electrostatic latent image corresponding to an original, not shown, is formed thereon by the exposure unit 3. The latent image is converted into a toner image by electrically attracting a toner dispersed in a developing solution which is contained in the developing unit 4. An excess amount of the developing solution which attaches to the surface of the photosensitive drum 1 is removed by the device 5. The drum 1 carrying an adequate amount of developing solution is brought into overlying relationship with the copy sheet which is fed along a path 7 by a paper feeder, not shown, whereupon the transfer charger 6 functions to transfer the toner image onto the copy sheet. Thus, the developing solution retained in the form of the toner image on the drum surface is transferred onto the copy sheet. Subsequent to the transfer step, the copy sheet is separated from the drum surface by a scraper, not shown, and is fed by a pair of rollers 8 into a heat fixing appratus.

The heat fixing apparatus fixes a visual toner image, which is formed on the surface of the copy sheet by transfer, by drying the copy sheet which is wetted with the developing solution. Describing the heat fixing apparatus, which is schematically shown in FIG. 2, the copy sheet 9 carrying the toner image is fed by a pair of feed rollers 10 onto a heated plate 11, below which a heat source 12, such as an electrical heater or the like, is disposed for supplying heat to the plate 11. The copy sheet 9, which retains the toner image by the developing solution 9 either impregnated in or attached to the surface thereof, is heated and dried while being conveyed on the heated plate 11, whereby the visual image is fixed.

In heat fixing apparatus of this kind, the fixing efficiency increases with an increased degree of contact between the copy sheet and the heated plate even though it is also influenced by the heat capacity of the heated plate. To increase the degree of contact between the copy sheet and the heated plate, various means have been proposed, including 1) applying air pressure to the copy sheet to urge it against the heated plate, 2) disposing a pinch roller above the heated plate to urge the copy sheet thereagainst mechanically, 3) charging the copy sheet electrically to produce an electrostatic attraction to the heated plate, and 4) applying vacuum to produce a negative pressure at the opposite ends of the heated plate so as to attract the copy sheet for close contact.

However, the application of air pressure requires the provision of a blower, which increases the mechanical size of the apparatus. This is true also with a use of the vacuum. The charging of the copy sheet is subjected to a disadvantageous variation in the degree of contact depending on temperature and other parameters, thus preventing the achievement of a constant degree of contact. Where a pinch roller is used, the roller is rotated with a linear speed equal to that of the copy sheet where the heated plate is flat and the roller makes a line contact with the copy sheet. However, it is necessary to use a plurality of such rollers in order to increase the degree of contact between the copy sheet and the heated plate and to increase the area of such contact. It is possible that the clearance between the roller and the heated plate may be reduced to less than the thickness of the copy sheet in order to permit a close contact with a single roller, so that this technique may degrade the toner image and induce an offset phenomenon.

SUMMARY OF THE INVENTION

It is an object of the invention to eliminate all of the above-mentioned disadvantages by providing a compact heat fixing apparatus which increases the area of contact between a copy sheet and a heated plate to thereby improve the fixing efficiency.

DETAILED DESCRIPTION OF EMBODIMENTS

Figure 1:
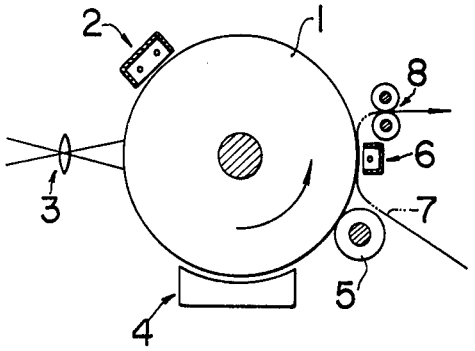
FIG. 1 PRIOR ART
FIG. 1 is a schematic elevation view of a conventional wet electrophotographic copying machine.
Figure 2:
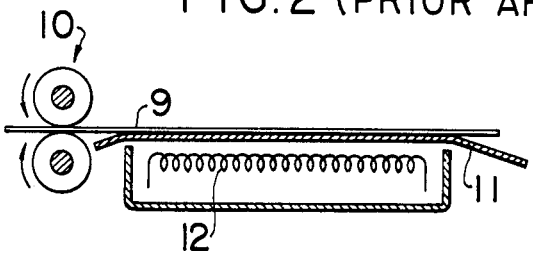
FIG. 2 (PRIOR ART)
FIG. 2 is a schematic side elevation view, partly in section of a conventional drying and fixing apparatus.
Figure 3:
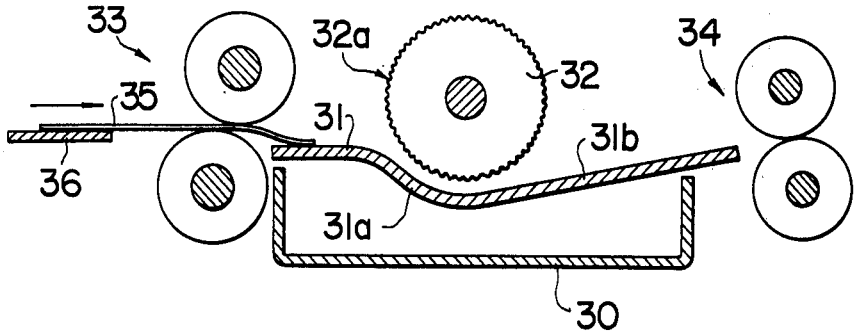
FIG. 3 is a schematic side elevation view, partly in section, of one embodiment of the invention.

Referring to FIG. 3, there is shown a housing 30 which internally houses a heat source (not shown) such as an electrical heater. A heated plate 31, which is heated by the heat source, is disposed above the housing 30, and is partly formed with an upwardly concave region **31*a*, or a curved surface region having a positive curvature, provided that it is measured while tracing the plate 31 from the left to the right in this figure. Disposed above the concave region 31*a* in the heated plate 31 is a guide member 32, which, in the example shown, is in the form of a roller, the clearance therebetween being slightly greater than the thickness of a copy sheet used. By way of example, with a paper thickness of 0.1 mm, the clearance may be chosen on the order of 0.5 to 1.0 mm. The concave region 31*a* comprises a first portion which is located adjacent to the periphery of the roller 32, and a second portion 31*b* which gradually slopes in the upward direction away from the roller. The depth of the concave region is chosen such that the copy sheet being conveyed can maintain the rigidity of the paper itself after being bent by the roller 32, or a depth which is sufficient to produce a resiliency in the paper. The guide roller 32 has a knurled surface 32***a*. A pair of feed rollers 33 are arranged to the left of the heated plate 31 and, such that the leading end of a copy sheet 35 nipped therebetween comes to contact with the sheet entry portion of plate 31 at a substantial angle as shown, while a pair of delivery rollers 34 are arranged to the right of sheet exit portion 31*b* of plate 31. It should be understood that these pairs of rolles 33, 34 are rotated with the same peripheral speed as the guide roller 32.

Figure 4:
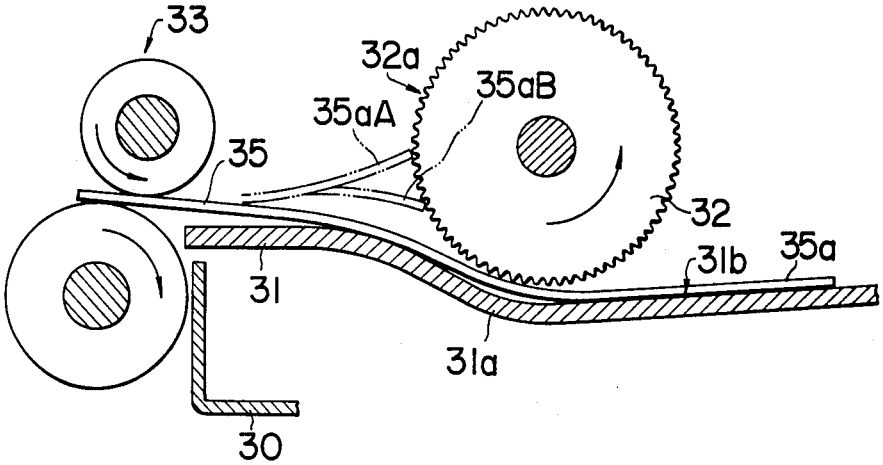
FIG. 4 is a fragmentary enlarged side elevation view, partly in section, of the apparatus shown in FIG. 3.

As the copy sheet 35, carrying a toner image on its surface which is wetted with the developing solution, is conveyed on a guide plate 36 with the tone image carrying surface facing upward, the pair of feed rollers 33 feeds it in a downwardly sloping direction onto the heated plate 31, and causes it to move forward therealong. When the leading end 35*a* (FIG. 4) of the copy sheet reaches the concave region 31*a*, the sheet tends to move straightforward owing to its rigidity, but is bent downwardly, toward the bottom of the concave region, by the guide roller 32 which has part of its knurled periphery disposed within the concave region and by virtue of contact with an introducing or charge portion of the curved surface region 31*a* as shown. The leading end of the copy sheet 35, which is thus bent, continues to be conveyed through the concave region 31*a*, and is caused to be curved in the opposite direction from the initial curvature in the introducing region. Thus, the copy sheet 35 is conveyed while maintaining a close contact with ascending exit portion 31*b*, following curved region 31*a* by virtue of its own resiliency. In this manner, a maximum utilization of the heat from the heated plate 31 by the copy sheet 35 is achieved, resulting in a perfect fixing and drying of the toner image. Subsequent to the drying and fixing, the copy sheet 35 is delivered by the pair of rollers 34.

The knurled surface 32*a* of the guide roller 32 minimizes the influence upon the image by reducing the area of contact with the copy sheet 35 when it is being bent. The reduced area of contact between the guide roller 32 and the surface of the copy sheet also greatly contributes to preventing an offset which is likely to occur during a heat fixing process. In addition, the knurled surface of the guide roller 32 is effective to positively engage the leading end of the copy sheet, as shown at 35*a*B, when such leading end fed into the apparatus is somewhat curled upwardly, as shown at 35*a*A.

By way of example, the clearance between the knurled peripheral surface of the guide roller 32 and the heated plate 31 is chosen on the order of about 0.5 to 1.0 mm when the thickness of the copy sheet 35 is about 0.1 mm. This facilitates a manual operation of the roller for maintenance or adjustment purposes since, when the heated plate 31 is at a temperture of about 200° C, the roller 32 will be heated only to a temperature around 50° C.

As compared with conventional arrangements, the apparatus according to the invention does not require an air stream directed toward the heated plate, so that a cooling of the surface of the heated plate is avoided, resulting in an improved thermal efficiency. A separation between the guide roller and the heated plate minimizes the adverse influences upon the image. The apparatus is free from the influence of temperature as will occur in an electrostatically attracted apparatus, and therefore provides a stabilized conveying operation for the copy sheet. There is no need for the provision of ventilation, suction, or charging means, thus simplifying the overall construction and enabling the apparatus to be assembled in a compact structure.

Figure 5:
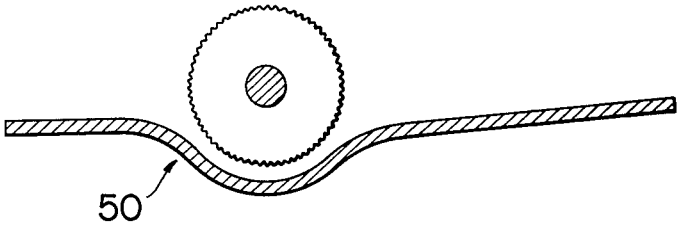
FIG. 5 is a schematic side elevation view, partly in section of another embodiment of the invention.

The configuration of the concave region formed in the heated plate depends on the rigidity of the paper used and the temperature used. FIG. 5 shows another configuration of the concave region which is designated by numeral 50.

Figure 6:
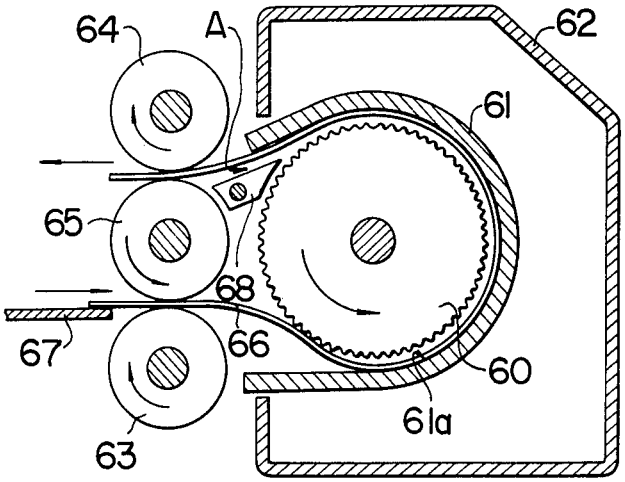
FIG. 6 is a schematic side elevation view, partly in section of a further embodiment of the invention.

FIG. 6 shows another embodiment of the invention which includes a guide roller 60 having a knurled surface and rotating in the direction indicated by an arrow. A curved heated plate 61 is disposed in surrounding relationship with the guide roller 60 with the clearance which is slightly greater than the thickness of a paper used, and is received within a housing 62 in which a heat source, not shown, is disposed for heating the plate 61. A feed roller 63, a delivery roller 64 and a common roller 65 are disposed adjacent the opposite ends of the heated plate 61, and are rotated in the directions indicated by arrows. The guide roller 60 is driven with the same peripheral speed as the rollers 63, 64 and 65.

In operation, when a copy sheet 66, having a toner image formed on its surface, is conveyed on a guide plate 67, the rollers 63, 65 cooperate to feed it toward the guide roller 60. The leading end of the copy sheet fed into the housing abuts against the knurled surface of the rotating guide roller, which guides it downwardly into the space between its peripheral surface and the surface of a concave region 61*a* formed in the heated plate 61, thus causing it to advance along the concave region 61*a* while maintaining a close contact therewith. In the course of such movement, the copy sheet 66 is dried and the toner image on its surface completely fixed. After completion of the drying and fixing, the copy sheet 66 is delivered outwardly by the rollers 64 and 65. At a discharge port A, as the copy sheet 66 leaves the heated plate 61, it advances straightforward owing to its rigidity and is held between the rollers 64 and 65. However, a suitable guide member 68 may be disposed in the outlet port A depending on the material and thickness of the copy sheet, thereby preventing the copy sheet from being wrapped around the guide roller. A close contact of the copy sheet 66 with the heated plate 31 is achieved by the resiliency of the sheet material itself as the copy sheet, moving straightforwardly is bent downwardly by the guide roller 60 and is forcedly conveyed along the concave region 61*a*. In this manner, the area of contact between the copy sheet and the heated plate is increased while minimizing the area of contact between the copy sheet or the toner image and the guide roller.

While specific embodiments of the invention have been show and described in detail to illustrate the application of the principles of the invention, it will be understood that the invention may be embodied otherwise without departing from such principles.

What is claimed is:

1. A heat fixing apparatus, for use in a wet electrophotographic copying apparatus for fixing a toner image carried on one surface of wet-developed copy sheets, comprising, in combination, heating means disposed along a path of movement of the wet copy sheets and including means forming a heating surface for sliding contact with the opposite surface of each sheet, said heating surface including, in the direction of travel of the copy sheets, a substantially planar sheet entry portion followed by a downwardly deflected, upwardly concave portion in turn followed by an upwardly extending sheet exit portion; heat source means operable to heat said heating surface; a rotatably mounted guide roller having a knurled peripheral surface facing said concave surface portion and spaced therefrom by a distance in excess of the thickness of the copy sheets, said roller being rotatable with a peripheral speed equal to the speed of travel of the copy sheets along said path of movement; and copy sheet feeding means, at a position upstream of said guide roller, operable to feed the copy sheets in said direction of travel toward said guide roller; the knurled peripheral surface of said guide roller engaging the copy sheets and deflecting the copy sheets into engagement with said concave surface portion of said heating surface, and the copy sheets, due to their inherent stiffness, remaining resiliently engaged with said concave and sheet exit portions of said heating surface.

2. A heat fixing apparatus according to claim 1, in which said copy sheet feeding means feeds the copy sheets toward said guide roller at a level above said sheet entry portion of said heating surface, whereby the wet copy sheets have an initial curvature downwardly toward said sheet entry portion of said heating surface and which curvature is opposite to the direction of curvature of the sheets in passing through said concave surface portion.

3. A heat fixing apparatus according to claim 1, wherein said feeding means comprises a pair of rollers for nipping each sheet therebetween and moving it in its travelling direction, the rollers being arranged such that the leading end of the copy sheet nipped and moved thereby extends into contact with said heating surface at a downwardly sloping angle thereto.

* * * * *